US009162135B2

(12) United States Patent
Niu

(10) Patent No.: US 9,162,135 B2
(45) Date of Patent: Oct. 20, 2015

(54) MULTIFUNCTIONAL PLAY TENT

(71) Applicant: D.J. TOYS ENTERPRISE CORP., Taichung (TW)

(72) Inventor: Li-Yang Niu, Taichung (TW)

(73) Assignee: D.J. TOYS ENTERPRISE CORP., Taichung (TW)

( * ) Notice: Subject to any disclaimer, the term of this patent is extended or adjusted under 35 U.S.C. 154(b) by 306 days.

(21) Appl. No.: 13/828,313

(22) Filed: Mar. 14, 2013

(65) Prior Publication Data

US 2014/0274490 A1 Sep. 18, 2014

(51) Int. Cl.

| | |
|---|---|
| ***A63B 63/00*** | (2006.01) |
| ***A63B 71/04*** | (2006.01) |
| ***A63B 63/08*** | (2006.01) |
| *E04H 15/00* | (2006.01) |

(52) U.S. Cl.

CPC ..... *A63B 71/04* (2013.01); *A63B 63/00* (2013.01); *A63B 63/083* (2013.01); *A63B 2063/001* (2013.01); *A63B 2208/12* (2013.01); *A63B 2209/10* (2013.01); *A63B 2210/50* (2013.01); *E04H 15/006* (2013.01)

(58) Field of Classification Search

CPC .. A63B 63/004; A63B 63/00; A63B 2208/12; A63B 2063/001; A63B 2210/54

USPC ..... 473/478, 485; 273/352, 400–402; 446/110, 227; 52/2.11; D6/610

See application file for complete search history.

(56) References Cited

U.S. PATENT DOCUMENTS

| | | | | | |
|---|---|---|---|---|---|
| 600,712 | A * | 3/1898 | Brown | 473/107 |
| 5,722,446 | A * | 3/1998 | Zheng | 135/125 |
| 5,788,242 | A * | 8/1998 | Rudell et al. | 273/317.3 |
| 5,833,557 | A * | 11/1998 | Cole | 473/472 |
| 6,073,643 | A * | 6/2000 | Zheng | 135/125 |
| 6,082,386 | A * | 7/2000 | Zheng | 135/126 |
| 6,192,635 | B1 * | 2/2001 | Zheng | 135/126 |
| 6,607,455 | B1 * | 8/2003 | Petras | 473/478 |
| 6,766,815 | B2 * | 7/2004 | Zheng | 135/143 |
| 7,031,147 | B2 * | 4/2006 | Zheng | 361/679.01 |
| 7,363,932 | B2 * | 4/2008 | Zheng | 135/126 |
| 7,404,562 | B2 * | 7/2008 | Chen et al. | 273/317.3 |
| 2014/0274490 | A1 * | 9/2014 | Niu | 473/478 |

* cited by examiner

*Primary Examiner* — Gene Kim
*Assistant Examiner* — M Chambers
(74) *Attorney, Agent, or Firm* — Birch, Stewart, Kolasch & Birch, LLP

(57) ABSTRACT

A play tent has a tent body, a roof, and a game device board. The tent body has a ball opening. The roof is connected with the tent body and has a ball end moveable relative to the tent body to correspond to the top of the tent body or the ball opening. The game device board is mounted on the tent body. When the ball end is moved to a position corresponding to the ball opening, a child can pitch a ball towards the game device board, and then the ball rolls to the ball opening, such that the child can pitch the ball again. When the ball end is moved to a position corresponding to the top of the tent body, the child can be engaged in other activities inside the tent body. Therefore, the play tent can provide multiple functions for use.

14 Claims, 8 Drawing Sheets

MULTIFUNCTIONAL PLAY TENT

BACKGROUND OF THE INVENTION

1. Field of the Invention

The present invention relates to a play tent, and more particularly to a multifunctional play tent.

2. Description of Related Art

With reference to FIG. 8, a conventional play tent 50 is set up by multiple flexible steel columns and covered by a screen. The conventional play tent 50 comprises an opening 60. The opening 60 is formed in a side of the play tent 50 and selectively sheltered by a curtain 61. A child can enter or exit the play tent 50 through the opening 60.

The play tent 50 can provide a private space for the child. The child can read books, sleep, or do other activities in the play tent 50, which can help the child to develop an independent personality. However, the child can only be engaged in sedentary activities in the play tent 50, so the functionality of the conventional play tent 50 is insufficient.

SUMMARY OF THE INVENTION

The main object of the present invention is to provide a multifunctional play tent, which comprises a tent body, a roof, and a game device board.

The tent body has a top, a bottom, a periphery formed between the top and the bottom, a tent space formed in the tent body, a gateway formed through the periphery and communicating with the tent space, a roof opening formed through the tent body, located in the top of the tent body, and communicating with the tent space, and at least one ball opening formed through the periphery, communicating with the tent space, and having at least one bottom corresponding to the at least one ball opening in amount.

The roof is connected with the tent body, selectively closes the roof opening, and has a connecting end connected with the tent body and opposite to the at least one ball opening, and a ball end opposite to the connecting end. The roof is moveable relative to the tent body with respect to the connecting end, and is selectively combined with the tent body. The game device board is mounted on the at least one ball opening.

The roof can be put down to make the ball end correspond to the at least one ball opening. A child can pitch or kick a ball toward the game device board, and then the ball can roll along the roof to the at least one ball opening. The child can pick up the ball from the at least one ball opening again. Alternatively, the roof can close the roof opening. The child can enter into the tent space to be engaged in activities. Therefore, the play tent can provide the child with a variety of options to increase multiple functions for use.

DETAILED DESCRIPTION OF PREFERRED EMBODIMENT

Figure 1:
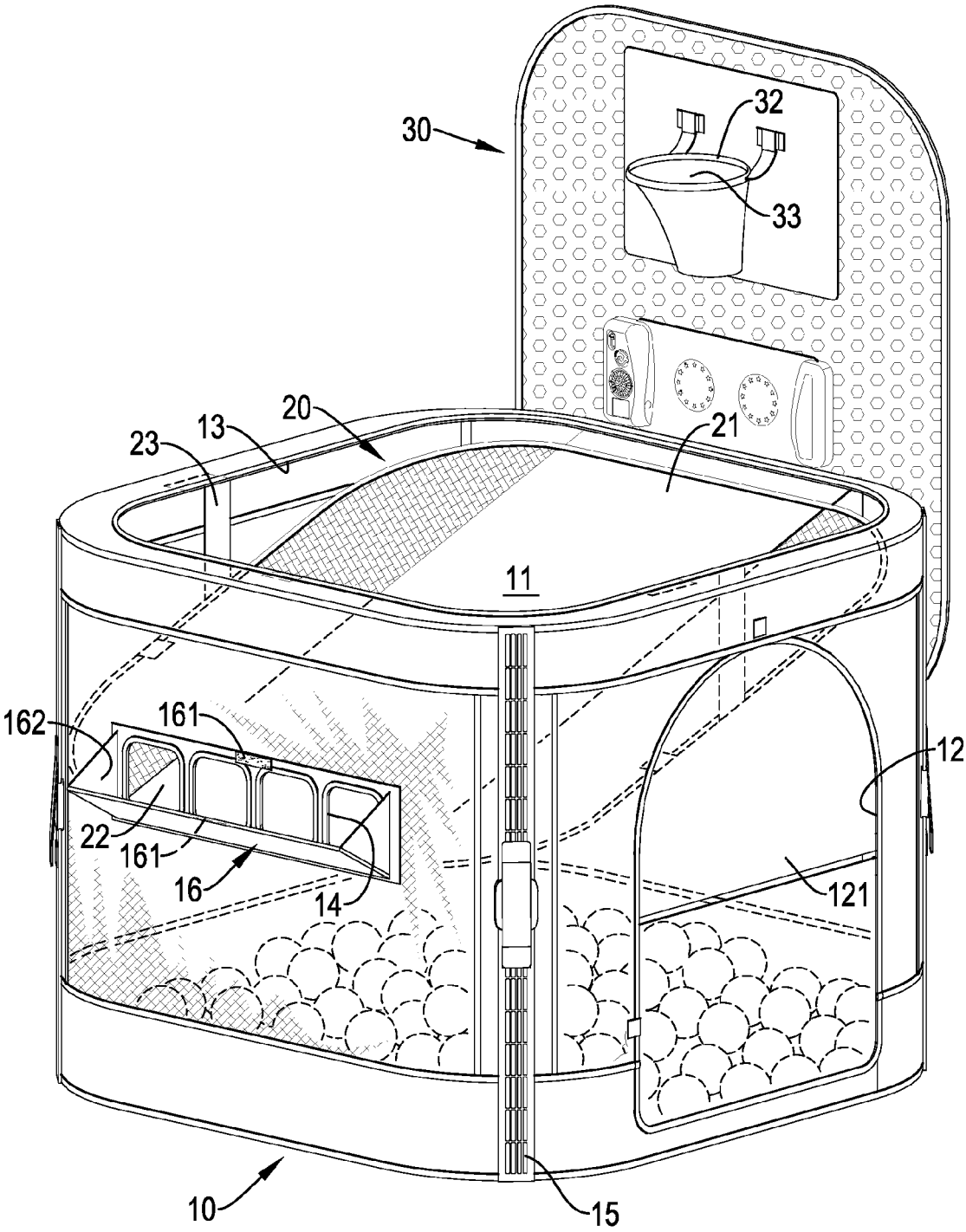
FIG. 1 is a perspective view of a first preferred embodiment of a multifunctional play tent in accordance with the present invention.

With reference to FIG. 1, a first preferred embodiment of a multifunctional play tent in accordance with the present invention comprises a tent body 10, a roof 20 and a game device board 30.

The tent body 10 is cubical and set up by multiple flexible steel columns. The tent body 10 comprises a bottom, a top, a periphery, four sides, a tent space 11, a gateway 12, a roof opening 13, four ball openings 14, and four support frames 15. The periphery is formed between the top and the bottom of the tent body 10. In the preferred embodiment, the tent body 10 is cubical, so the four sides are formed around the periphery. Alternatively, the tend body 10 may be spherical. The tent space 11 is formed in the tent body 10. The gateway 12 is formed through the periphery, is located in one of the sides of the tent body 10 and communicates with the tent space 11. A child can enter or exit the tent body 10 through the gateway 12, and the gateway 12 is selectively sheltered by a curtain 121 to increase privacy in the play tent. The roof opening 13 is formed in a top of the tent body 10 and communicates with the tent space 11. The ball openings 14 are formed through the periphery, located in one of the sides of the tent body 10 adjacent to the side in which the gateway 12 is formed, and the ball openings 14 are adjacent to the top of the tent body 10.

Figure 2:
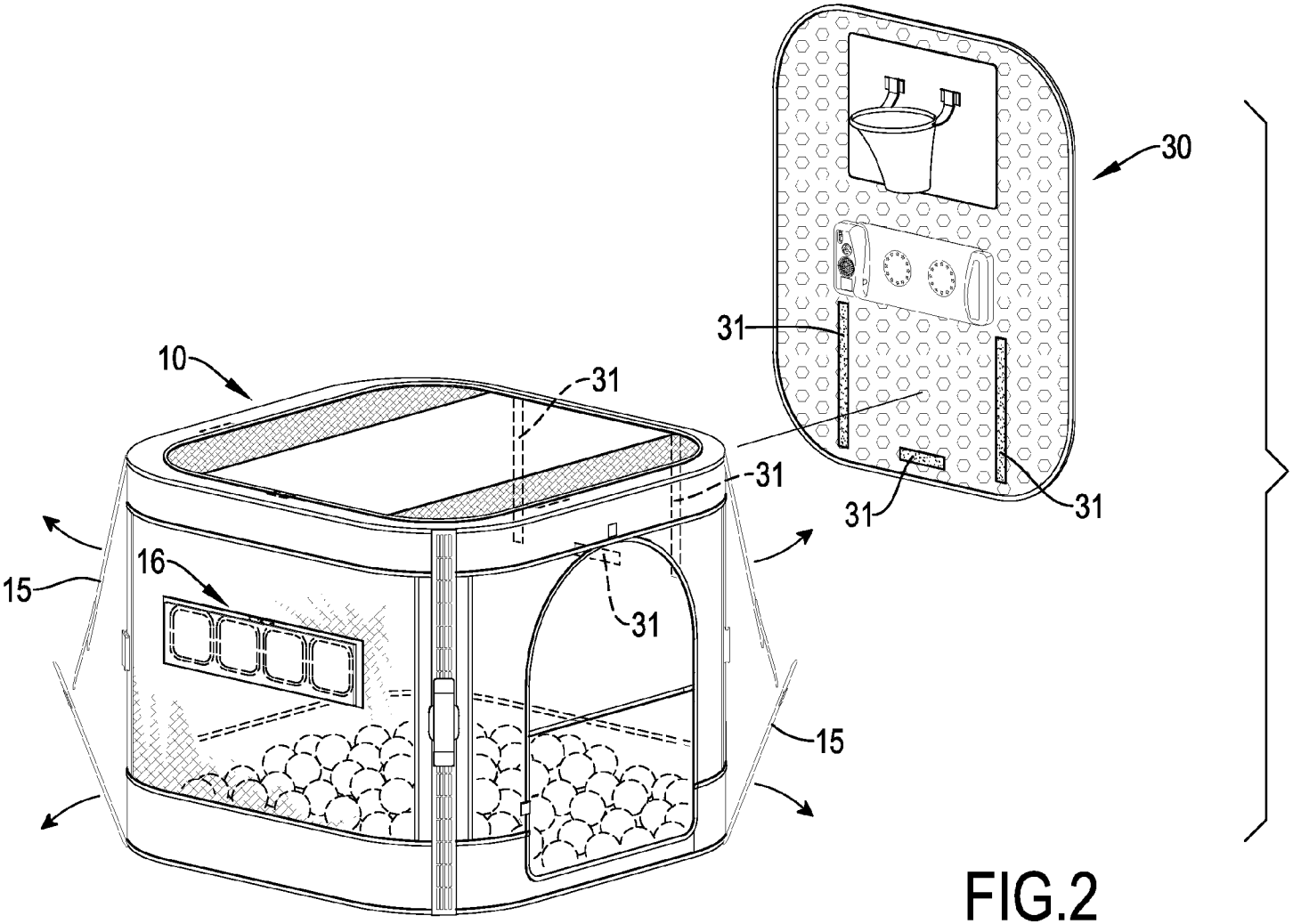
FIG. 2 is an exploded perspective view of the multifunctional play tent in FIG. 1.
Figure 3:
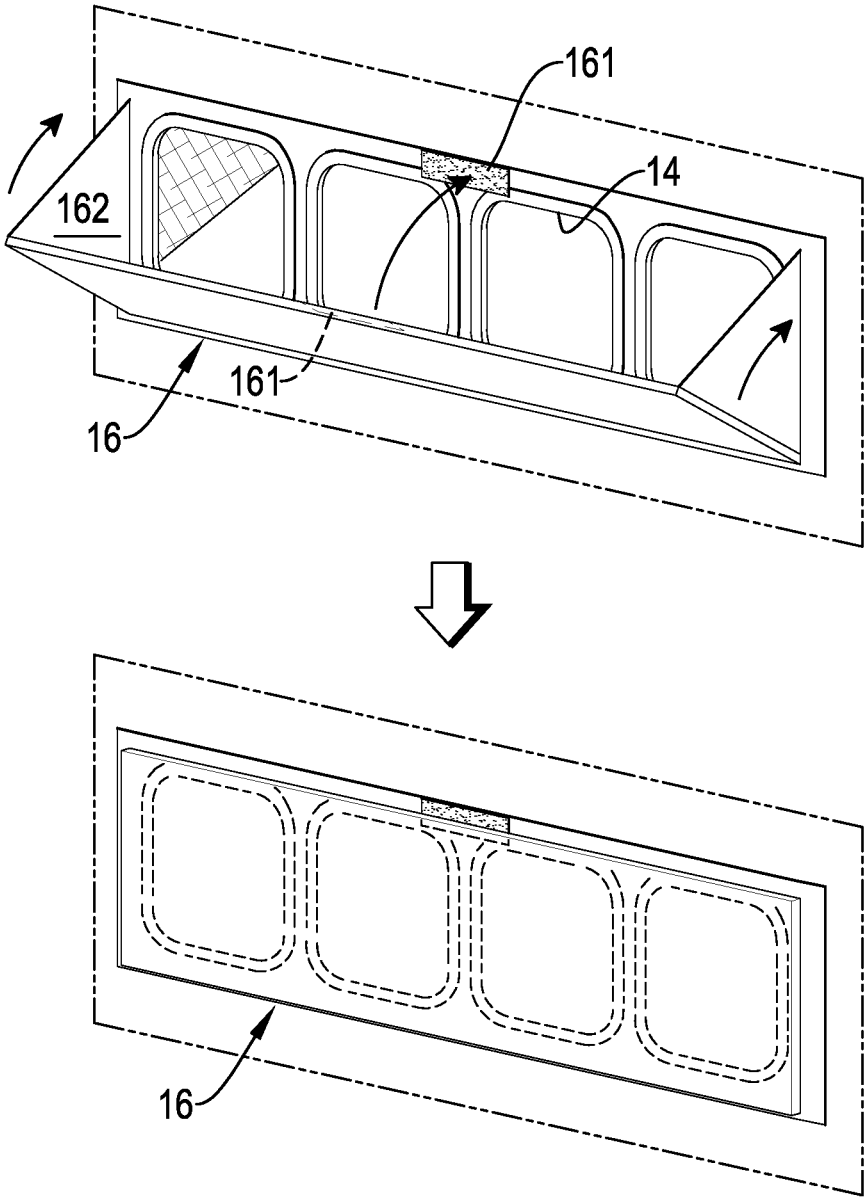
FIG. 3 is an operational perspective view of the multifunctional play tent in FIG. 1.

With reference to FIG. 1, FIG. 2, and FIG. 3, the support frames 15 are elongated and arranged around the periphery of the tent body 10. Each support frame 15 is connected between the top and the bottom of the tent body 10. The support frames 15 can be selectively disassembled, such that the tent body 10 can be folded to decrease the required storage space for the tent body 10 since the tent body 10 is set up by flexible steel columns. A rack 16 is connected with the tent body 10, is located out of the tent space 11 at a position corresponding to the ball openings 14, and has four sides. Three of the sides of the rack 16 are connected with the tent body 10, and the last one of the sides of the rack 16 is selectively combined with the tent body 10 to close the ball openings 14. The rack 16 is combined with the tent body 10 by velcros 161 or buckles. A rack space 162 is formed between the rack 16 and the tent body 10.

Figure 4:
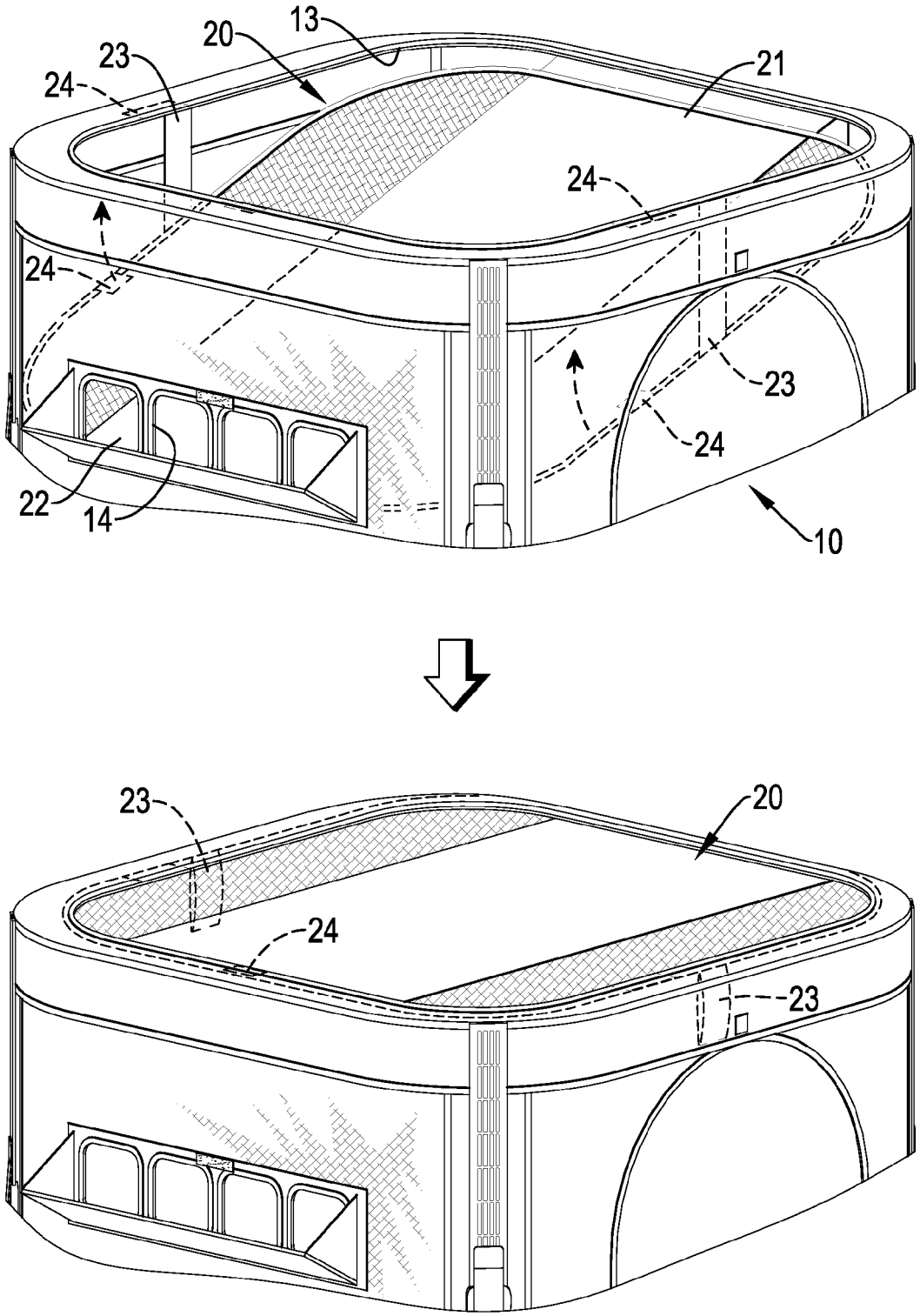
FIG. 4 is an operational perspective view of the multifunctional play tent in FIG. 1.
Figure 5:
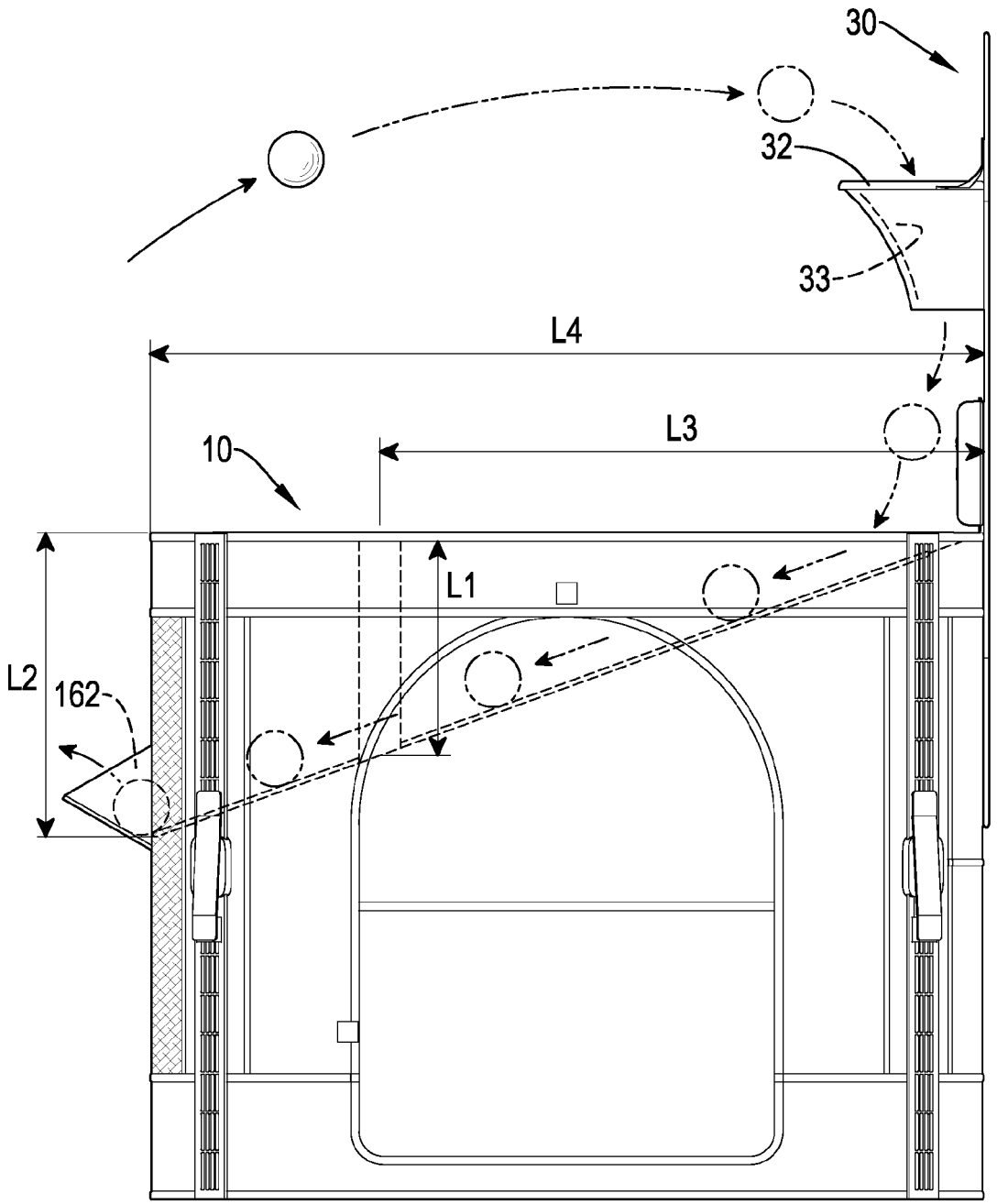
FIG. 5 is an operational side view of the multifunctional play tent in FIG. 1

With reference to FIG. 1, FIG. 4 and FIG. 5, the roof 20 is connected with the tent body 10 and selectively closes the roof opening 13. The roof 20 may be combined with the tent body to close the roof opening 13 by velcros 24 or buckles. The roof 20 comprises a connecting end 21 and a ball end 22. The connecting end 21 is connected with the side of the tent body 10 that is opposite to the ball openings 14, and is located in the top of the tent body 10. The ball end 22 is opposite to the connecting end 21 and is moveable relative to the tent body 10 with respect to the connecting end 21. The ball end 22 is either combined with the top of the tent body 10 or located at the bottom of the ball openings 14. Two connecting belts 23 are connected between the roof 20 and the top of the tent body 10 to hold and position the ball end 22 at the bottom of the ball openings 14. Each connecting belt 23 has a middle along the longitudinal direction of the connecting belt 23.

Each connecting belt 23 has a first length L1. A second length L2 is defined between the top of the tent body 10 and the bottom of the ball openings 14. A third length L3 is defined between the side of the tent body 10 that is opposite to the ball openings 14 and the middle of one of the connecting belts 23. A fourth length L4 is defined between the side of the tent body 10 corresponding to the connecting end 21 in position and the side of the tent body 10 corresponding to the ball openings 14 in position. The position of each of the connecting belts 23 relative to the roof 20 is proportional. The ratio of the first length L1 to the second length L2 is equal to that of the third length L3 to the fourth length L4. Therefore, when the roof 20 is put down, the ball end 22 is located at the bottom of the ball openings 14. Alternatively, the ball end 22 may be combined with the tent body 10 at a position corresponding to the bottom of the ball openings 14 by buckles or any other connecting structure.

With reference to FIG. 1, FIG. 2, and FIG. 5, the game device board 30 is mounted on the side of the tent body 10 that is opposite to the ball openings 14. The game device board 30 may be fixed on the tent body 10 or separably combined with the tent body 10. The game device board 30 may be combined with the tent body 10 by velcros 31 or buckles.

The game device board 30 has a ball basket 32 and a ball channel 33. The ball basket 32 is mounted on a side of the game device board 30 facing the tent body 10 and is located above the tent body 10. The ball channel 33 is formed in the ball basket 32 and extends toward the roof 20.

With reference to FIG. 1 and FIG. 5, in use, the roof 20 is put down until the ball end 22 corresponds to the ball openings 14 in position. A child can stand outside the tent body 10, face the ball openings 14, and pitch a ball into the ball basket 32. The ball goes through the ball channel 33, falls on the roof 20, rolls toward the ball openings 14 along the inclined roof 20, and enters the rack space 162 through one of the ball openings 14. The child can pick up the ball from the rack space 162 and pitch the ball again.

With reference to FIG. 1 and FIG. 4, the roof 20 can be lifted up to close the roof opening 13 and is combined with the tent body 10. A child can enter the tent body 10 and be engaged in sedentary activities. The play tent can provide a private space for the child to help the child develop an independent personality. When the play tent is not in use, the support frames 15 can be disassembled and then the tent body 10 can be folded to decrease the storage space.

Figure 6:
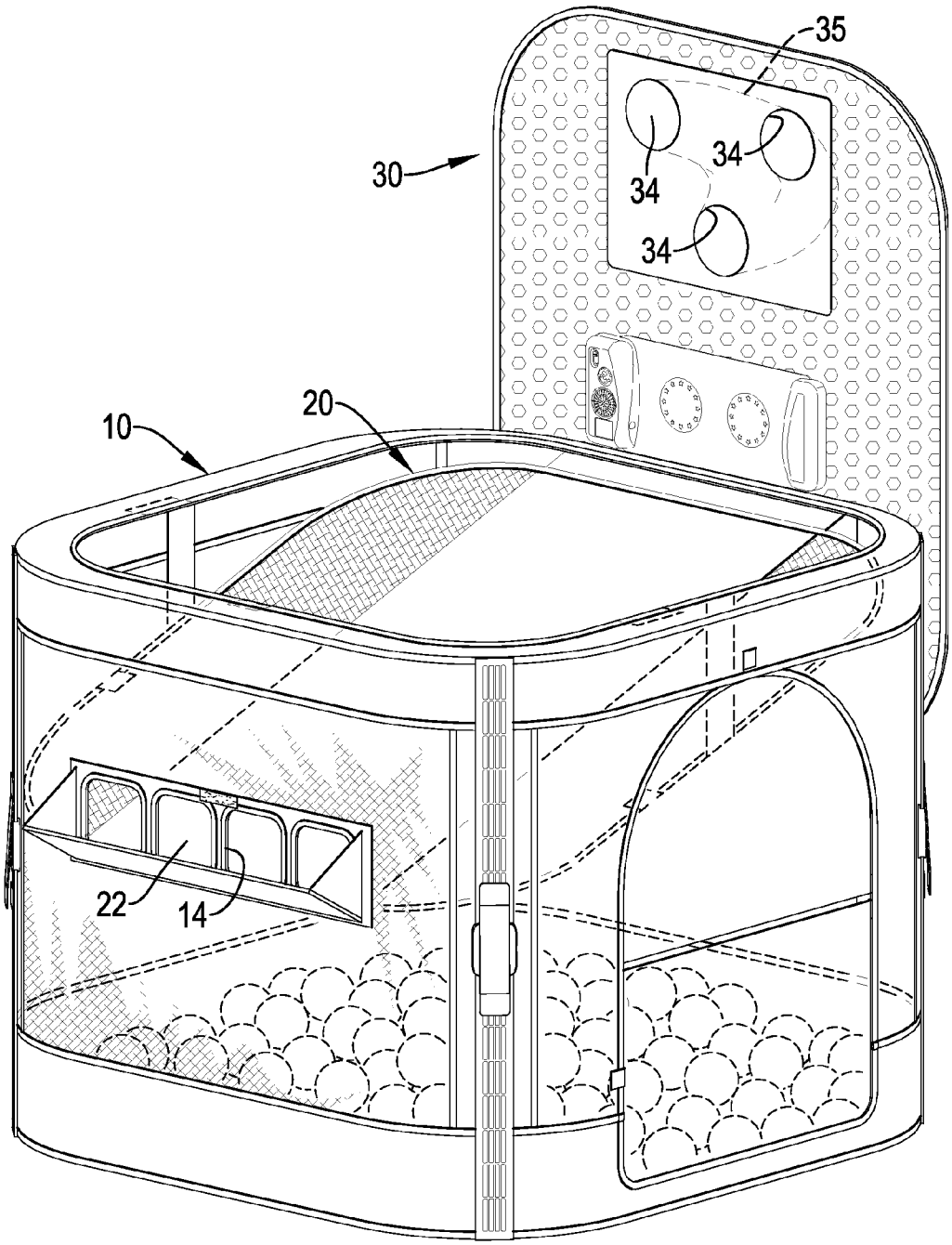
FIG. 6 is a perspective view of a second preferred embodiment of a multifunctional play tent in accordance with the present invention.
Figure 7:
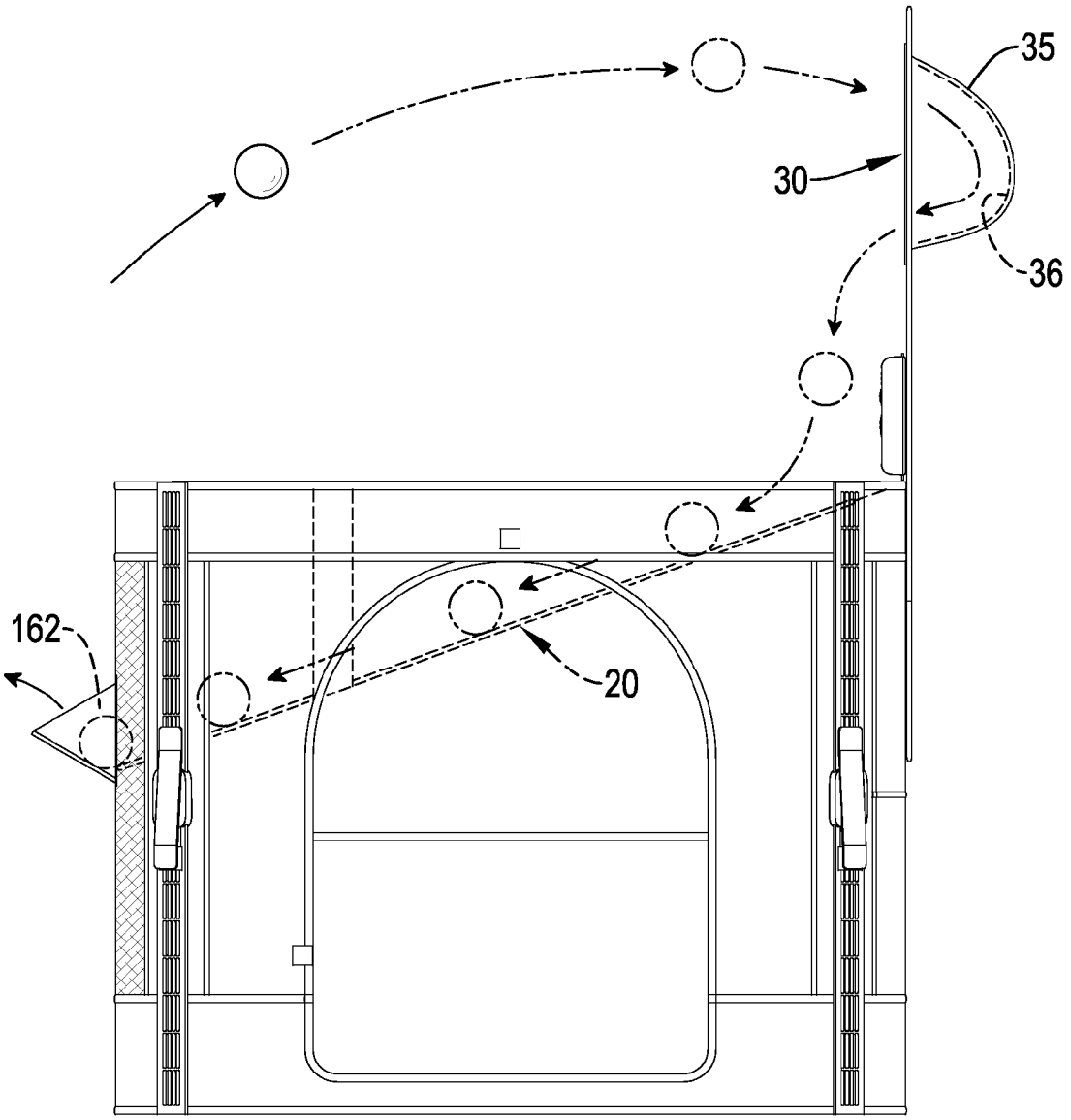
FIG. 7 is an operational side view of the multifunctional play tent in FIG. 6.
Figure 8:
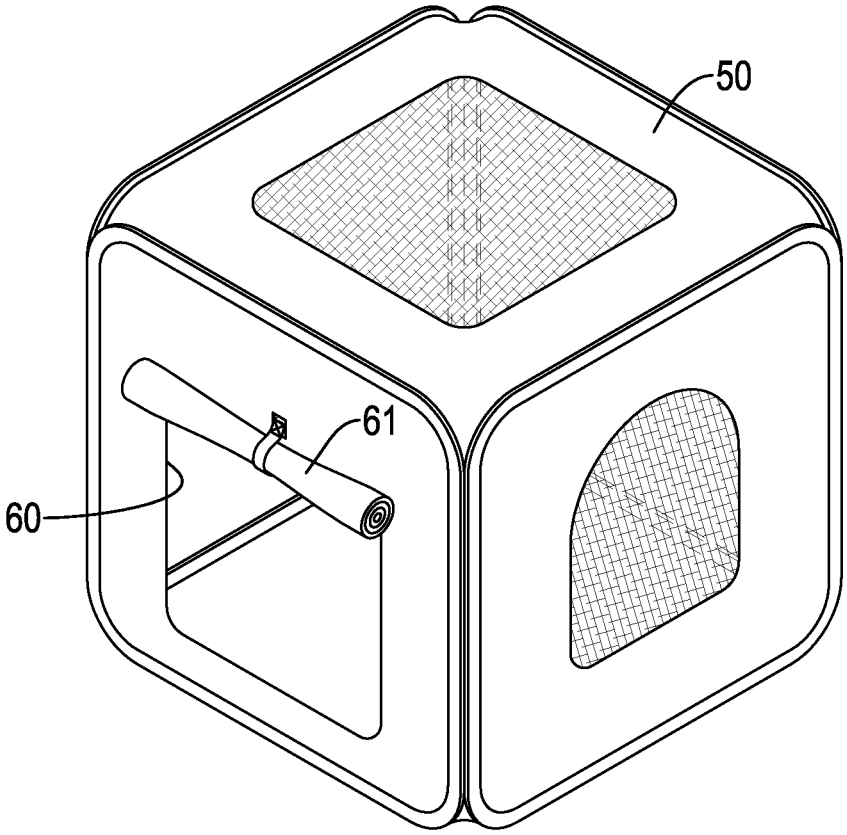
FIG.8 PRIOR ART
FIG. 8 is a perspective view of a conventional play tent.

With reference to FIG. 6 and FIG. 7, in a second preferred embodiment of the present invention, the game device board 30 comprises three board openings 34, a ball pocket 35, and a ball channel 36. The board openings 34 are formed through the game device board 30. The ball pocket 35 is connected with the game device board 30 at a side opposite to the tent body 10 and communicates with the board openings 34. The ball channel 36 is formed in the ball pocket 35.

In use, the roof 20 is put down to correspond to the ball openings 14 in position. A child can stand outside the tent body 10 facing the ball openings 14, and throw or kick a ball through one of the board openings 34 to enter the ball pocket 35. The ball moves in the ball channel 36, exits the ball pocket 35 through one of the board openings 34 and falls on the roof 20. The ball will roll toward the ball openings 14 along the inclined roof 20 and enter the rack space 162. The child can pick up the ball from the rack space 162 and throw or kick the ball again.

What is claimed is:

1. A play tent comprising:

a tent body having a top;

a bottom;

a periphery formed between the top and the bottom;

a tent space formed in the tent body;

a gateway formed through the periphery and communicating with the tent space;

a roof opening formed through the tent body, located in the top of the tent body, and communicating with the tent space; and at least one ball opening formed through the periphery, communicating with the tent space, and each one of the at least one ball opening having a bottom;

a roof connected with the tent body, selectively closing the roof opening and having a connecting end connected with the tent body and being opposite to the at least one ball opening; and a ball end opposite to the connecting end, the ball end being moveable relative to the tent body with respect to the connecting end, and selectively combined with the tent body;

a connecting belt connected between the top of the tent body and the roof;

at least one hook and loop fastener mounted between the roof and the tent body to selectively combine the roof with the tent body; and a game device board separably mounted on the tent body and being opposite to the at least one ball opening and wherein a ball basket is mounted on the game device board facing the tent body; and a ball channel is formed in the ball basket and extends toward the roof.

2. The play tent as claimed in claim 1, wherein the tent body further has multiple support frames, wherein each support frame is elongated and disassemblably connected between the top and the bottom of the tent body.

3. The play tent as claimed in claim 2, wherein a ball basket is mounted on the game device board facing the tent body; and a ball channel is formed in the ball basket and extends toward the roof.

4. The play tent as claimed in claim 2, wherein multiple board openings are formed through the game device board;

a ball pocket is connected with the game device board opposite to the tent body and communicates with the board openings; and a ball channel is formed in the ball pocket.

5. The play tent as claimed in claim 2 further comprising:

a rack connected with the tent body, located out of the tent space at a position corresponding to the at least one ball opening, and selectively closing the at least one ball opening.

6. The play tent as claimed in claim 5, wherein a ball basket is mounted on the game device board facing the tent body; and a ball channel is formed in the ball basket and extends toward the roof.

7. The play tent as claimed in claim 5, wherein multiple board openings are formed through the game device board;

a ball pocket is connected with the game device board opposite to the tent body and communicates with the board openings; and a ball channel is formed in the ball pocket.

8. The play tent as claimed in claim 5, wherein the connecting belt has a middle;

a first length is defined along the connecting belt;

a second length is defined between the top of the tent body and the at least one bottom of the at least one ball opening;

a third length is defined between a side of the tent body that is opposite to the at least one ball opening and the middle of the connecting belt;

a fourth length is defined between a side of the tent body corresponding to the connecting end in position and the side of the tent body corresponding to the at least one ball opening in position; wherein a ratio of the first length to the second length is equal to a ratio of the third length to the fourth length.

9. The play tent as claimed in claim 8, wherein a ball basket is mounted on the game device board facing the tent body; and a ball channel is formed in the ball basket and extends toward the roof.

10. The play tent as claimed in claim 8, wherein multiple board openings are formed through the game device board;

a ball pocket is connected with the game device board opposite to the tent body and communicates with the board openings; and a ball channel is formed in the ball pocket.

11. The play tent as claimed in claim 8, wherein at least one velcro is mounted between the rack and the tent body to selectively combine the rack and the tent body; and at least one velcro is mounted between the game device board and the tent body to selectively combine the tent body and the game device board.

12. The play tent as claimed in claim 11, wherein a ball basket is mounted on the game device board facing the tent body; and a ball channel is formed in the ball basket and extends toward the roof.

13. The play tent as claimed in claim 11, wherein multiple board openings are formed through the game device board;

a ball pocket is connected with the game device board opposite to the tent body and communicates with the board openings; and a ball channel is formed in the ball pocket.

14. The play tent as claimed in claim 1, wherein multiple board openings are formed through the game device board;

a ball pocket is connected with the game device board opposite to the tent body and communicates with the board openings; and a ball channel is formed in the ball pocket.

* * * * *